United States Patent [19]

Cameron

[11] 4,147,199

[45] Apr. 3, 1979

[54] DRAPERY SUPPORT COMBINATION

[75] Inventor: John K. Cameron, Warwick, R.I.

[73] Assignee: Kenney Manufacturing Company, Warwick, R.I.

[21] Appl. No.: 860,591

[22] Filed: Dec. 14, 1977

[51] Int. Cl.[2] ..... E06B 9/20

[52] U.S. Cl. ..... 160/330; 211/105.6

[58] Field of Search ..... 160/123-125, 160/330; 16/87 R, 87.2, 87.4, 87.6, 87.8; 211/105.1, 105.4, 105.6

[56] References Cited

U.S. PATENT DOCUMENTS

| | | | |
|---|---|---|---|
| 519,840 | 5/1894 | Edsall | 211/105.6 |
| 2,079,267 | 5/1937 | Vroom et al. | 211/105.4 |
| 2,199,851 | 5/1940 | Culver | 211/105.4 |
| 2,652,586 | 9/1953 | Ramsberger | 248/264 |
| 2,840,158 | 6/1958 | Lee | 160/123 |

FOREIGN PATENT DOCUMENTS

| | | | |
|---|---|---|---|
| 1337034 | 7/1963 | France | 211/105.6 |
| 161936 | 1/1958 | Sweden | 211/105.6 |

*Primary Examiner*—Peter M. Caun

[57] ABSTRACT

A curtain supporting combination including a telescoping rod, ring and wall arrangement with elements including compression spring mechanism arranged to act in concert to mount the curtain and support and anchor the upper end of the curtain in close abutment with the wall at the end of the rod and at the same level as the main supporting level of the rod.

3 Claims, 4 Drawing Figures

DRAPERY SUPPORT COMBINATION

This invention relates to drapery hardware and more particularly to a combination for supporting a curtain in close juxtaposition to a wall.

BACKGROUND OF THE INVENTION

One of the problems associated with curtain supports, particularly for shower curtains, has to do with keeping the side of the curtain snugly against the wall so as to prevent or reduce the hazard of the escape of water from within the shower stall. The usual rod support for shower curtains comprises a base, hub, or finial which anchors the end of the rod to the wall. The rod then carries supporting rings located along the rod away from the base and from the wall. With such an arrangement the rings tend to slide along the rod leaving a gap between the curtain and the wall, and even when they are pushed toward the wall, the rod supporting hub or finial prevents them from moving into close abutment with the wall. It is, of course, possible to provide a tie-back arrangement such as a perforated, depending flange adapted to receive a curtain carrier adjacent to the wall, at the upper side edge of the curtain as is employed in numerous prior art drapery brackets, but such arrangements are not well suited for use with plain cylindrical shower curtain rods and shower curtains which are supported by rings which slide on the rod, because such tie-back arrangements are located below the rod and cannot support the end ring at the same height as the rings on the rod. This gives the final ring a lower position and is consequently unsightly. As a result, plain cylindrical shower curtain rods are normally sold without any provision for holding the upper end of the curtain edge closely adjacent to the wall of the shower stall.

SUMMARY OF THE INVENTION

The primary object of the present invention is to provide a simple, convenient, and efficient combination for supporting a curtain closely adjacent to a wall. More particularly it is an object to provide an improved shower curtain support combination adapted to hold the upper end of the side edge of the curtain securely against the wall of the shower stall.

In the accomplishment of these and other objects of the invention, in a preferred embodiment thereof I employ a pair of hollow cylindrical rods arranged in telescoping relation with an internal, adjustable spring compression mechanism and with the rods adapted to fit between two opposed vertical walls of a shower stall and be held there in position by the pressure of the spring mechanism. The respective exposed ends of the rod are each provided with an enlarged finial which abuts the wall and anchors the rod in place by frictional engagement with the wall. Rings are provided to support the curtain, the rings being larger in diameter than the rod, but smaller in diameter than the maximum diameter of the finial. The finial, however, has a portion of reduced diameter adjacent to its end of smaller diameter than the rings, which smaller portion is adapted to receive and retain a ring at the end of the combination adjacent to the wall.

Thus, it is a feature of the invention that the compression mechanism which holds the rod in place, also cooperates in the function of holding the end ring in position adjacent to the shower stall wall. Another feature is that the rod and curtain supporting combination can be assembled away from the shower stall, with rings mounted both on the main part of the rod and at both ends, and, thereafter placed in position in the shower stall by adjustment of the spring compression element of the rod.

DESCRIPTION OF THE PREFERRED EMBODIMENT

Figure 1:
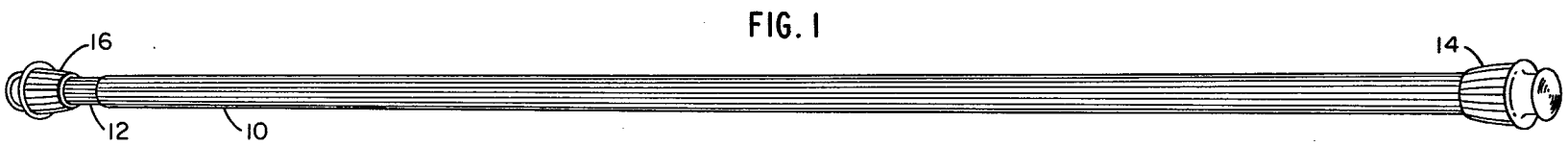
FIG. 1 is a view in perspective of a cylindrical curtain rod according to the present invention.
Figure 2:
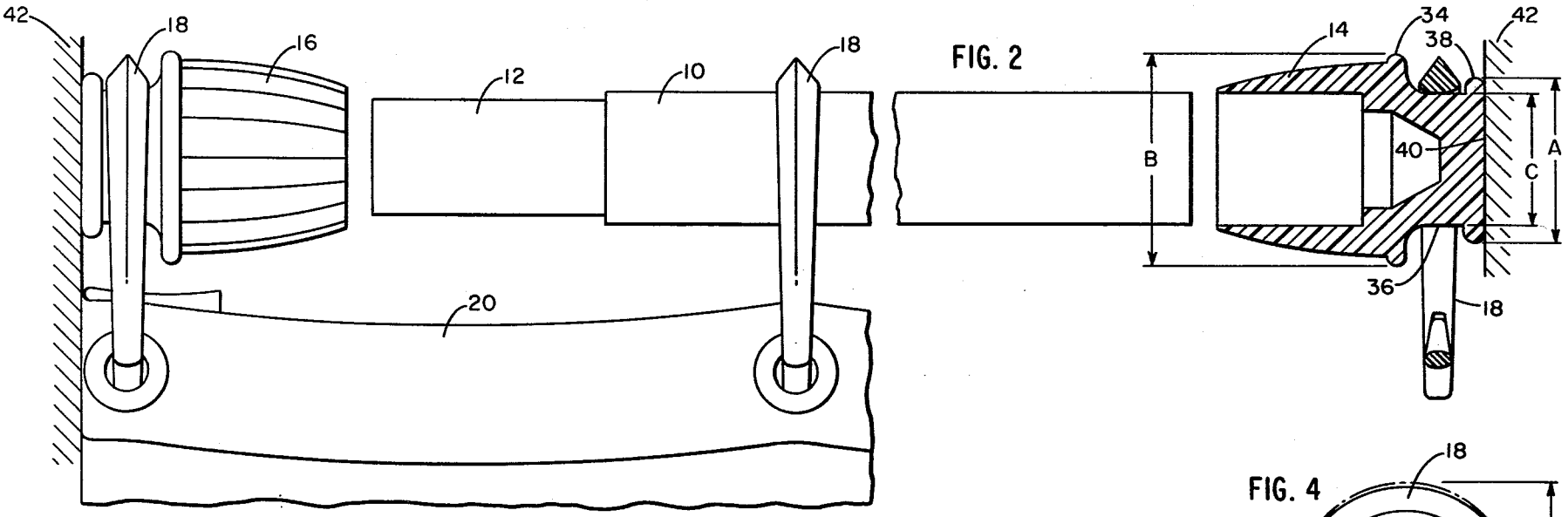
FIG. 2 is an enlarged partially exploded, partially sectioned view in front elevation of the rod, ring, and wall combination of the invention.

The preferred embodiment of the present invention comprises a pair of hollow tubular telescoping rod sections, the outer sections being designated 10 and the inner section 12. The rod sections may be of rolled, drawn or extruded tubing and may be decoratively fluted as in FIG. 1. The rod sections 10 and 12 are provided at their outer ends with finials respectively 14 and 16. The two finials are identical except that finial 16 has a smaller inside diameter than finial 14 in order to fit snugly onto the smaller diameter inner rod section 12. Rings 18 are mounted on the rod and serve to support a curtain 20.

Figure 3:
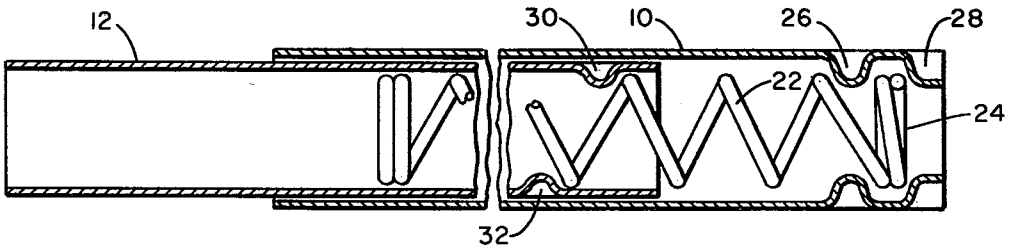
FIG. 3 is a view in cross-section of the rod showing the adjustable spring compression elements.

An adjustable spring compression arrangement is provided within the rod as shown in FIG. 3, in which a helical spring 22 having an end 24 anchored within rod section 10 by indentations 26 and 28. The spring 22 extends into the interior of rod section 12 where it is held in threaded engagement by indentations 30 and 32 at the inner end of rod section 12. In this way the rod sections 10 and 12 may be compressed in telescoping relation against the compression of the spring in the area between indentations 28 and 30, and the total effective length of the rod can be adjusted by rotating the rod sections 10 and 12 relative to each other. By this arrangement the rod can be placed in the shower stall and twisted to effectively lengthen it until a sufficiently tight fit is attained.

Figure 4:
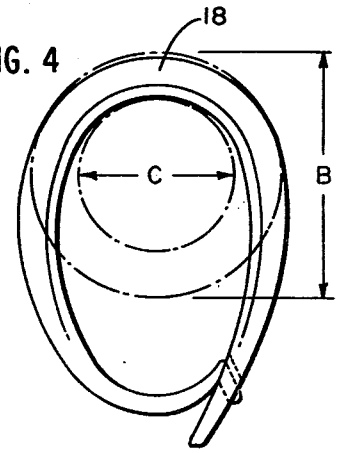
FIG. 4 is an end view of a ring and supporting element showing the diameter relationships of the ring and finial.

The finials 14 and 16 are provided with an enlarged part 34 having a diameter designated at B in FIG. 4 which is larger than the maximum opening of rings 18. In addition, finials 14 are provided with an annular groove 36 of narrower diameter designated at C in FIG. 4 which is smaller than the smallest inside diameter of the rings 18, and approximately the same size as the rod sections. The upper level of annular groove 36 is at approximately the same height as the upper level of rod sections 10 and 12 (but for the difference in diameter between the sections). An annular bead 38 of larger diameter than groove 36 is provided at the end of the finials 14 and 16. The bead 38, however, is still smaller in diameter than the smallest inside diameter of rings 18, so that rings 18 may be placed on the end of the finial over bead 38 and retained there by gravity during installation. Ends 40 of the finials 14 and 16 abut against wall portions 42. If desired a friction surface or coating (not shown) may be applied to ends 40 to ensure secure engagement.

The operation of the invention is as follows. When the shower stall and the curtain 20 are in condition of readiness, the rods 10 and 12 are twisted to provide a length slightly larger than the opening between wall portions 42. The rod is then mounted in the shower stall at the correct height by compressing it lengthwise, inserting it in place, and letting it spring upwardly into firm engagement with the wall portions 42. Next the rings 18 are opened, placed over the rod, through grommets in the curtain, and then closed. At each end, one ring 18 is placed in annular groove 36 so as to anchor the upper edge of the curtain securely against the wall at substantially the same level as all of the other rings 18. Assembly and installation may also be accomplished by attaching the rings to the curtain and mounting them on the rod away from the shower stall, where it is more convenient to manipulate the closure of the rings. Then, with the combination assembled and a ring at each end being held in place (by gravity) by beads 38, it can be lifted into place in the shower stall, and then installed as above. In addition, it will be seen that solid rings may be used. Solid rings may first be attached to the curtain, and then mounted on the rod by removing one finial and sliding the rings onto the rod. The end rings, of course, will simply fit over beads 38. In such an assembled state, the rod carrying the curtain can then be mounted in the shower stall.

In view of this preferred embodiment, other forms of the invention will now be apparent to those skilled in the art. For example, in certain cases where it may be desireable to hold other forms of curtain up against an abutting wall as, for instance, for the prevention of the leakage of light at night, or for thermal insulation integrity, the arrangement herein described will have advantages. Therefore, it is not intended to limit the invention to shower curtains, but to curtain rod, ring and wall combinations which employ the mode of operation herein described. Other modifications will also be apparent, and therefore it is not intended to confine the invention to the precise form herein shown but rather to limit it in terms of the appended claims:

I claim:

1. A drapery support comprising in combination;

a curtain rod comprising a pair of hollow telescoping tubes;

a helical compression spring within said tubes;

means for securing said spring to one said tube;

means for threadedly engaging said spring to the other said tube whereby twisting said tubes relative to each other effectively lengthens the rod;

a curtain;

a finial at each end of said rod, having an enlarged middle part;

rings mounted on said rod;

means connecting said curtain to said rings;

the inside dimensions of the opening of said rings being limited to prevent said rings from passing over the enlarged middle part of said finial;

an annular groove in said finial nearer to the end of said finial than said middle part the diameter of said annular groove being smaller than the minimum inside diameter of said rings whereby said annular groove is adapted to receive and retain a ring adjacent to the end of said finial;

a pair of walls in opposed relation defining a curtain receiving opening; and said rod mounted between said walls under spring compression supporting said curtain by rings on said rod and by one ring in each said annular groove.

2. The combination defined in claim 1 further characterized by the supporting level of said annular groove being substantially at the same height as the supporting level of said rod.

3. The combination defined in claim 1 further characterized by an annular bead at the end of said finial adjacent to said annular groove having a diameter larger than said annular groove but smaller than the inside diameter of said rings whereby said rings may be retained in said grooves by gravity while said rod is being lifted into operative position.

* * * * *